US009429364B2

(12) United States Patent
Thompson et al.

(10) Patent No.: US 9,429,364 B2
(45) Date of Patent: Aug. 30, 2016

(54) CERAMIC LINED CHANNEL INDUCTOR

(75) Inventors: Darren Kenneth Thompson, Langwarrin (AU); Nega Setargew, Figtree (AU); William Joseph Gleeson, Harkaway (AU); Gerry Cardozo, Rowville (AU); John Anthony Spink, Shell Cove (AU); Craig Roulston, Shell Cove (AU)

(73) Assignee: Bluescope Steel Limited, Melbourne (AU)

( * ) Notice: Subject to any disclaimer, the term of this patent is extended or adjusted under 35 U.S.C. 154(b) by 86 days.

(21) Appl. No.: 13/638,674

(22) PCT Filed: Mar. 29, 2011

(86) PCT No.: PCT/AU2011/000351

§ 371 (c)(1),
(2), (4) Date: Oct. 9, 2012

(87) PCT Pub. No.: WO2011/120079

PCT Pub. Date: Oct. 6, 2011

(65) Prior Publication Data

US 2013/0075963 A1 Mar. 28, 2013

(30) Foreign Application Priority Data

Mar. 29, 2010 (AU) ..... 2010901328

(51) Int. Cl.

| | |
|---|---|
| ***F27D 11/06*** | (2006.01) |
| ***F27B 14/06*** | (2006.01) |
| ***F27D 1/00*** | (2006.01) |

(52) U.S. Cl.

CPC ..... *F27D 11/06* (2013.01); *F27B 14/061* (2013.01); *F27D 1/0003* (2013.01); *F27D 1/0006* (2013.01)

(58) Field of Classification Search

CPC ..... F27D 1/0006; F27D 1/10
USPC ..... 266/234, 286, 44
See application file for complete search history.

(56) References Cited

U.S. PATENT DOCUMENTS 4,615,675 A * 10/1986 Vorel ..... 432/4
5,134,629 A 7/1992 Cullan

FOREIGN PATENT DOCUMENTS

| | | | |
|---|---|---|---|
| DE | 2939295 | 5/1980 | |
| EP | 0069094 | 1/1983 | |
| EP | 0182345 A2 * | 5/1986 | ..... C04B 35/101 |
| SU | 960517 | 9/1982 | |
| SU | 1377555 | 2/1988 | |

OTHER PUBLICATIONS

International Search Report for Application No. PCT/AU2011/000351 dated May 19, 2011 (3 pages).

* cited by examiner

*Primary Examiner* — Scott Kastler
(74) *Attorney, Agent, or Firm* — Michael Best & Friedrich LLP

(57) ABSTRACT

A channel inductor of a channel induction furnace is disclosed. The channel inductor comprises a channel liner that defines a channel for a molten metal to flow through the channel inductor. The channel liner comprises an inlet and an outlet for the molten metal and a flange for mounting the channel liner to a refractory material lining of a pot of the channel inductor furnace. The channel liner being formed from a ceramic material that is resistant to chemical attack by the molten metal in the channel, whereby in use of the channel induction furnace direct contact between the molten metal and the channel inductor is limited to contact with the channel liner (including the flange) only and molten metal does not contact other parts of the channel inductor.

2 Claims, 2 Drawing Sheets

CERAMIC LINED CHANNEL INDUCTOR

The present invention relates to channel inductors of channel induction furnaces.

In particular, the present invention relates to channel liners of channel inductors.

The present invention also relates to channel inductor furnaces.

Channel induction furnaces are used in industries for melting a metal (which term includes metal alloys) and maintaining the metal in a molten state. For example, channel induction furnaces are used in galvanising and foundry industries for melting Zn-containing alloys and Al-containing alloys, including Al/Zn-containing alloys, and maintaining the alloys in a molten state.

A known channel induction furnace comprises (a) a steel shell, (b) a lining of a refractory material, such as an aluminosilicate, internally of the shell, (c) a pot for containing a bath of molten metal that is defined by the refractory-lined shell, and (d) one or more than one channel inductor for heating metal that is connected to the shell and in fluid communication with the pot via a throat that extends through the refractory-lined shell to an inlet in the channel inductor.

The channel inductor comprises (i) a steel shell, (ii) a lining of a refractory material, such as an aluminosilicate, (either castable or dry-vibratable refractory), (iii) a channel defined by the refractory-lined shell that forms a path for molten metal to flow from the pot through the channel and back into the pot, and (iv) an electromagnetic coil which generates an electromagnetic field. The molten metal in the channel at any given time becomes a secondary circuit of a transformer and is heated and kept molten by currents induced by the electromagnetic field. The channel inductor is a bolt-on assembly on the shell. The refractory material that forms the lining is selected to accommodate a range of specific mechanical requirements, thermal insulation requirements, and resistance to chemical attack by Al and/or Zn requirements. These requirements are competing requirements to a certain extent in the sense of needing different material properties and hence the selection of the refractory material tends to be a compromise.

Channel inductors have a limited life in Zn-containing and Al-containing alloys and typically fail in the following modes:

- Cracking of the refractory material, particularly along central planes of channel inductors, during heat-up, dry-out, or operation, and subsequent penetration of Zn and/or Al metal or Zn vapours into the cracks which extend the cracks, ultimately resulting in a metal leak from the channel inductors.
- Additionally, in the case of Al-containing alloys, by reduction of $SiO_2$ in the refractory material by Al, thereby forming $Al_2O_3$ and Si, with an associated reduction in the volume of the refractory material and penetration and/or spalling of the refractory material.

Typically, the life of channel inductors in Al containing alloys is 6-24 months and is one of the main reasons for metal coating line shut-downs.

The above discussion is not intended to be a statement of the common general knowledge in Australia and elsewhere.

The present invention provides a channel inductor of a channel induction furnace, the channel inductor comprising a channel liner that defines a channel for a molten metal to flow through the channel inductor, the channel liner comprising an inlet and an outlet for the molten metal and a flange for mounting the channel liner to a refractory material lining of a pot of the channel inductor furnace, and the channel liner being formed from a ceramic material that is resistant to chemical attack by the molten metal in the channel, whereby in use of the channel induction furnace direct contact between the molten metal and the channel inductor is limited to contact with the channel liner (including the flange) only and molten metal does not contact other parts of the channel inductor.

The term "chemical attack" is understood herein to mean thermodynamic reduction of refractory oxides (in this case by contact with molten metal, such as Al, in the furnace) or penetration of refractory by molten metal (such as Zn or Al or Zn—Al alloy) or vapours (such as Zn).

The above-described construction of the channel liner makes it possible for different parts of the channel inductor to be made from different materials, each of which is selected to be optimum in terms of required properties for that part of the channel inductor. Specifically:

- The channel liner may be formed from a material that is chemically resistant to attack by the molten metal (such as Al and/or Zn containing alloys) in the pot. Consequently, in the case of molten metal in the form of Zn-containing and Al-containing alloys, there is reduced risk of Zn vapour or Zn-containing or Al-containing molten alloy penetration through the liner into the refractory material that forms a support for the channel liner. This is particularly the case in situations where the liner is made as a single-piece unit.
- The refractory material that forms a channel liner support of the channel inductor, which could be a castable or dry-vibratable material, can be optimised for thermal insulation material properties and mechanical strength properties, such that the integrity of the channel liner is not compromised during heat-up, dry-out, or operation of the channel induction furnace.

The channel liner may be made as a single piece unit.

The channel liner may be any suitable shape.

The channel liner may be made from any suitable material.

The channel liner may be an elongate unit with the channel being in the shape of a single U ("single loop inductor"). More particularly, the channel may comprise two arms extending from a base of the channel, with a molten metal inlet in an end of one arm of the channel and a molten metal outlet in an end of the other arm of the channel, whereby molten metal can flow through one arm to the base and through the base to the other arm and along the other arm.

The channel liner may be an elongate unit with the channel being in the shape of a double U. More particularly, the channel may comprise three arms extending from a base of the channel that interconnects the arms, with a molten metal inlet in an end of a central arm of the channel and molten metal outlets in the ends of the outer arms of the channel, whereby molten metal can flow through the inner arm to the base and outwardly through the base to the outer arms and along the outer arms.

The channel liner may have a top wall, with the inlet and the outlet(s) formed in the top wall, and with the mounting flange extending outwardly from the top wall.

The channel liner may comprise a side wall that extends from a perimeter of the top wall, with the mounting flange extending outwardly from an upper edge of the side wall. This arrangement defines a vestibule or a forebay.

The channel liner may be made from any suitable ceramic material in terms of chemical resistance to the molten metal.

The channel inductor may comprise a support for the channel liner, with the support comprising a refractory material.

The refractory material of the channel liner support may be selected to have optimal thermal insulation material properties and mechanical strength properties for the channel inductor.

The channel liner support may further comprise an outer steel shell.

The present invention also provides a channel liner for a channel inductor that defines a channel for a molten metal to flow through the channel inductor, the channel liner comprising an inlet and an outlet for the molten metal and a flange for mounting the channel liner to a refractory material lining of a pot of the channel inductor furnace, and the channel liner being formed from a ceramic material that is resistant to chemical attack by the molten metal in the channel, whereby in use of the channel induction furnace direct contact between the molten metal and the channel inductor is limited to contact with the channel liner (including the flange) only and molten metal does not contact other parts of the channel inductor.

The channel liner may be made as a single piece unit.

The channel liner may be any suitable shape.

The channel liner may be made from any suitable material.

The channel liner may be an elongate unit with the channel being in the form of a single U, with the channel comprising two arms extending from a base of the channel, and with a molten metal inlet in an end of one arm of the channel and a molten metal outlet in an end of the other arm of the channel, whereby molten metal can flow through one arm to the base and through the base to the other arm and along the other arm.

The channel liner may be an elongate unit with the channel being in the form of a double U, with the channel comprising three arms extending from a base of the channel that interconnects the arms, and with a molten metal inlet in an end of a central arm of the channel and molten metal outlets in the ends of the outer arms of the channel, whereby molten metal can flow through the inner arm to the base and outwardly through the base to the outer arms and along the outer arms.

The channel liner may have a top wall, with the inlet and the outlet(s) being formed in the top wall, and with the mounting flange extending outwardly from the top wall.

The channel liner may comprise a side wall that extends from a perimeter of the top wall, with the mounting flange extending outwardly from an upper edge of the side wall. This arrangement defines a vestibule or a forebay.

The channel liner may be made from any suitable ceramic material in terms of chemical resistance to the molten metal.

The present invention also provides a channel inductor furnace that comprises:

(a) a steel shell,
(b) a lining of a refractory material internally of the shell,
(c) a pot for containing a pool of molten metal that is defined by the refractory-lined shell, and
(d) one or more than one of the above-described channel inductor for heating a metal that is connected to the shell and in fluid communication with the pot via a throat that extends through the shell and the refractory lining to the inlet in the channel inductor.

The present invention is described further by way of example with reference to the accompanying drawings, of which:

FIG. 1 is a cross-section of the main components of a channel inductor furnace 3 for pre-melting an Al/Zn alloy for use in a metal coating line for steel strip. It is noted that the present invention is not limited to this end-use and may be used as part of any suitable channel induction furnace and for any suitable end-use application.

Figure 1:
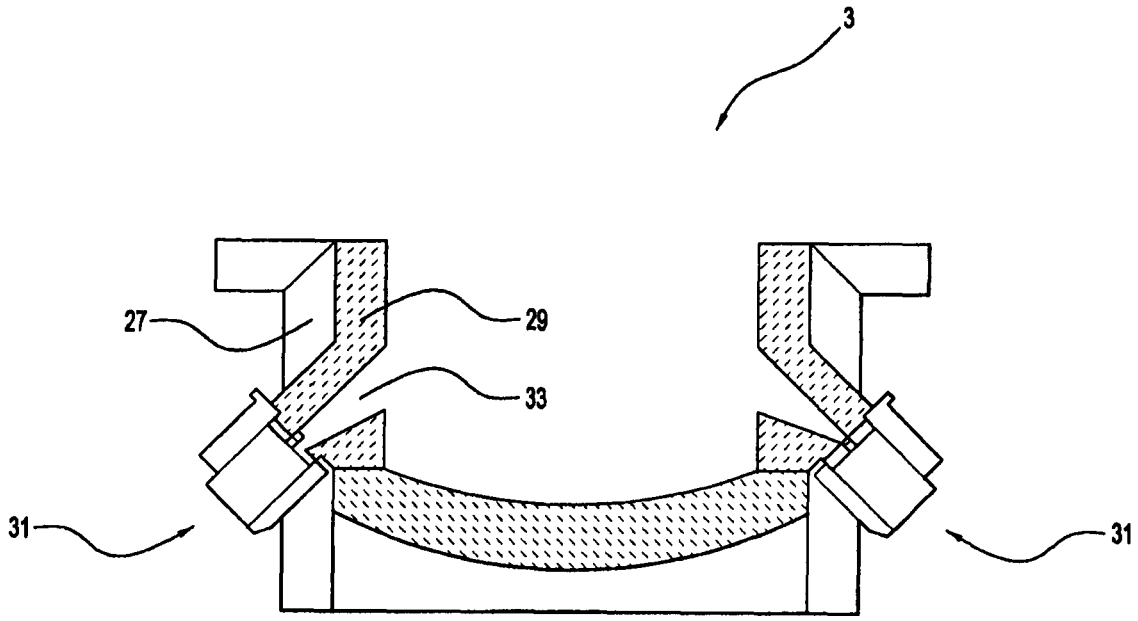
FIG. 1 is a vertical cross-section through one embodiment of a channel inductor furnace in accordance with the present invention that includes one embodiment of a channel inductor in accordance with the present invention.

The channel inductor furnace 3 shown in FIG. 1 comprises a pot defined by an outer steel shell 27 and an inner lining 29 of a refractory material, such as an aluminosilicate. In use, the pot contains a bath of Al/Zn alloy. The furnace 3 also includes two channel inductors 31 that are connected to opposed side walls of the steel shell 27 and are in fluid communication with the bath via respective throats 33. In use, molten Al/Zn alloy flows from the bath and into and through the channel inductors 31 and is heated by the channel inductors 31.

Figure 2:
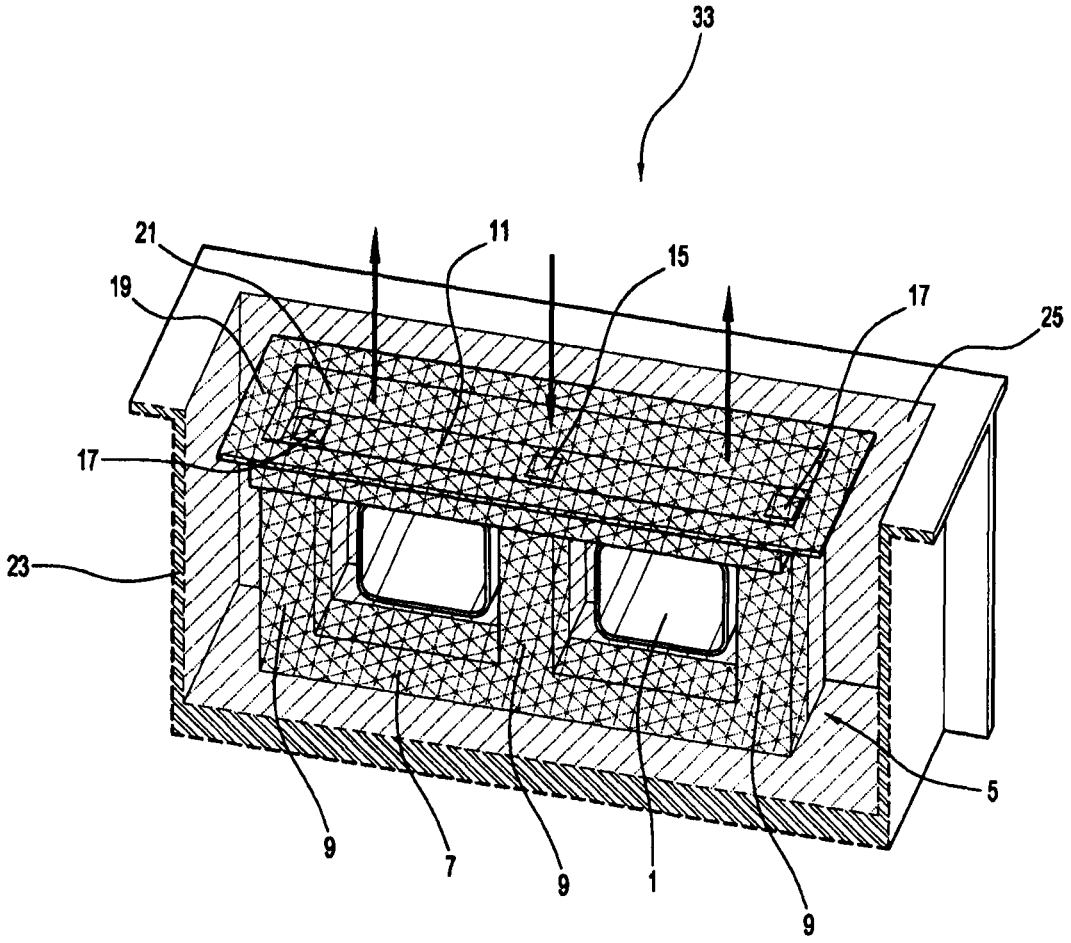
FIG. 2 is a vertical cross-section through one embodiment of a channel inductor in accordance with the present invention.

The drawing of the channel inductor 33 in FIG. 2 is a vertical cross-section in order to show the components of the inductor that are particularly relevant to the present invention. In addition, in order to make these components as clear as possible, the electromagnetic coil of the inductor 33 is not included in the openings 1 in the drawing.

The channel inductor 33 comprises:

(a) a channel liner, generally identified by the numeral 5, and
(b) a support for the channel liner.

The channel liner 5 is moulded from a material that is a chemically resistant material with respect to molten Al/Zn alloy and Zn vapour. The channel liner 5 is a single piece elongate unit that defines the above-mentioned openings 1 and a double "U" shaped channel for molten Al/Zn alloy to flow through the channel inductor. The channel comprises a base and three parallel arms 9 extending from the base. The upper end of the central arm of the channel is an inlet 15 for molten Al/Zn alloy and the upper ends of the outer arms of the channel are outlets 17 for molten Al/Zn alloy. The base of the channel is defined by a base section 7 of the channel liner 5 and the arms of the channel are defined by upstanding sections 9 of the channel liner 5. These sections 7, 9 are thin-walled, hollow sections. The channel liner 5 has a top wall 11, and the inlet 15 and the outlets 17 for molten Al/Zn alloy flow are formed in the top wall 11. The channel liner 5 also comprises a side wall 21 that extends around the perimeter of the top wall 11 and a flange 19 that extends outwardly from the side wall 21. The top wall 11 and the side wall 21 define a vestibule or forebay. The flange 19 is provided to mount the channel liner 5 to a refractory material lining (not shown) that defines a pot throat (not shown) of a pot (not shown) of the channel inductor furnace, whereby direct contact between molten Al/Zn alloy and the channel inductor is limited to contact with the channel liner 5 only.

The channel liner support comprises an outer steel shell 23 and an inner lining 25 of a refractory material. The refractory material fills the space between the shell 23 and the channel liner 5. Because contact between molten Al/Zn alloy and the channel inductor is confined to contact with the channel liner 5, the refractory material can be selected from a refractory material that is optimal for thermal insulation and mechanical strength for the channel inductor and without taking into account chemical resistance properties.

The above described channel inductor minimises chemical attack and cracking as failure modes for the channel inductor.

Many modifications may be made to the embodiment of the present invention described above without departing from the spirit and scope of the invention.

By way of example, the present invention is not confined to the particular shape of the channel inductor 3 shown in the drawing.

By way of further example, the present invention is not confined to a double "U" channel liner 5 and, by way of example, also extends to single "U" channel liners 5.

By way of further example, the present invention is not confined to a channel liner 5 that is formed as a single piece unit.

The invention claimed is:

1. A channel inductor of a channel induction furnace, the channel inductor comprising:

(a) a channel liner that defines a channel for a molten metal contained in a pot of molten metal in fluid communication with the channel liner to flow through the channel inductor, the channel comprising a base and three parallel arms extending from the base, with a central arm including an inlet for the molten metal and each outer arm including an outlet for the molten metal, the channel liner comprising a vestibule or a forebay defined by a top wall, a side wall extending upwardly from a perimeter of the top wall, and a mounting flange for mounting the channel liner to a refractory material lining of a pot of the channel inductor furnace extending outwardly from an upper edge of the side wall, with the inlet and the outlets of the channel being formed in the top wall, and the channel liner being moulded as a single-piece unit from a ceramic material that is resistant to chemical attack by the molten metal in the channel, whereby in use of the channel induction furnace direct contact between the molten metal and the channel inductor is limited to contact with the channel liner (including the flange) only and molten metal does not contact other parts of the channel inductor;

(b) a support of the channel liner, the support comprising an outer shell and a lining of a refractory material positioned between the outer shell and the ceramic material of the channel liner, and with the refractory material being selected from a material that is optimal for thermal insulation and mechanical strength for the channel inductor; and (c) an electromagnetic coil.

2. A channel inductor furnace that comprises:

(a) a refractory lined shell including a steel shell and a lining of a refractory material internally of the shell, the refractory lined shell also including a base and an upwardly extending side;

(b) a pot for containing a pool of molten metal that is defined by the refractory lined shell;

(c) a plurality of channel inductors as defined in claim 1 for heating a metal that is contained in the pot, with each channel inductor connected to the shell and in fluid communication with the pot; and (d) a plurality of throats interconnecting the pot and the channel inductors, with each throat extending through the side of the refractory lined shell to the inlet and the outlets in the channel inductors.

* * * * *